US006032709A

United States Patent [19]

Fedeli

[11] Patent Number: 6,032,709

[45] Date of Patent: Mar. 7, 2000

[54] SELF-EMPTYING BAG

[76] Inventor: Benedetto Fedeli, 7 Av. San Reman, Monaco, Monaco

[21] Appl. No.: 09/160,897

[22] Filed: Sep. 25, 1998

[30] Foreign Application Priority Data

Sep. 30, 1997 [EP] European Pat. Off. ..... 97830478

[51] Int. Cl.[7] ..... A45C 13/18; B65D 30/00; B65D 81/02

[52] U.S. Cl. ..... 150/102; 383/3; 206/522

[58] Field of Search ..... 750/102; 206/522; 383/3

[56] References Cited

U.S. PATENT DOCUMENTS

| | | | |
|---|---|---|---|
| 2,461,588 | 2/1949 | Cooper | 150/102 |
| 3,727,657 | 4/1973 | Landis | 150/102 |
| 4,014,374 | 3/1977 | Doughlas, Sr. | 150/102 |
| 5,458,164 | 10/1995 | Tawil | 206/522 X |
| 5,507,578 | 4/1996 | Ozeri et al. | 206/522 X |

*Primary Examiner*—Gary E. Elkins
*Assistant Examiner*—Tri M. Mai
*Attorney, Agent, or Firm*—Buckman and Archer

[57] ABSTRACT

A self-emptying handbag having a bag portion for carrying articles, a strap attached to the bag for carrying purposes, an expandable sack carried within the bag portion and having a volume when expanded greater than the volume of the bag portion, and an arrangement for expanding the expandable sack when the strap attached to the bag is suddenly pulled so that the articles therein are ejected from the bag.

4 Claims, 1 Drawing Sheet

SELF-EMPTYING BAG

Figure 1:
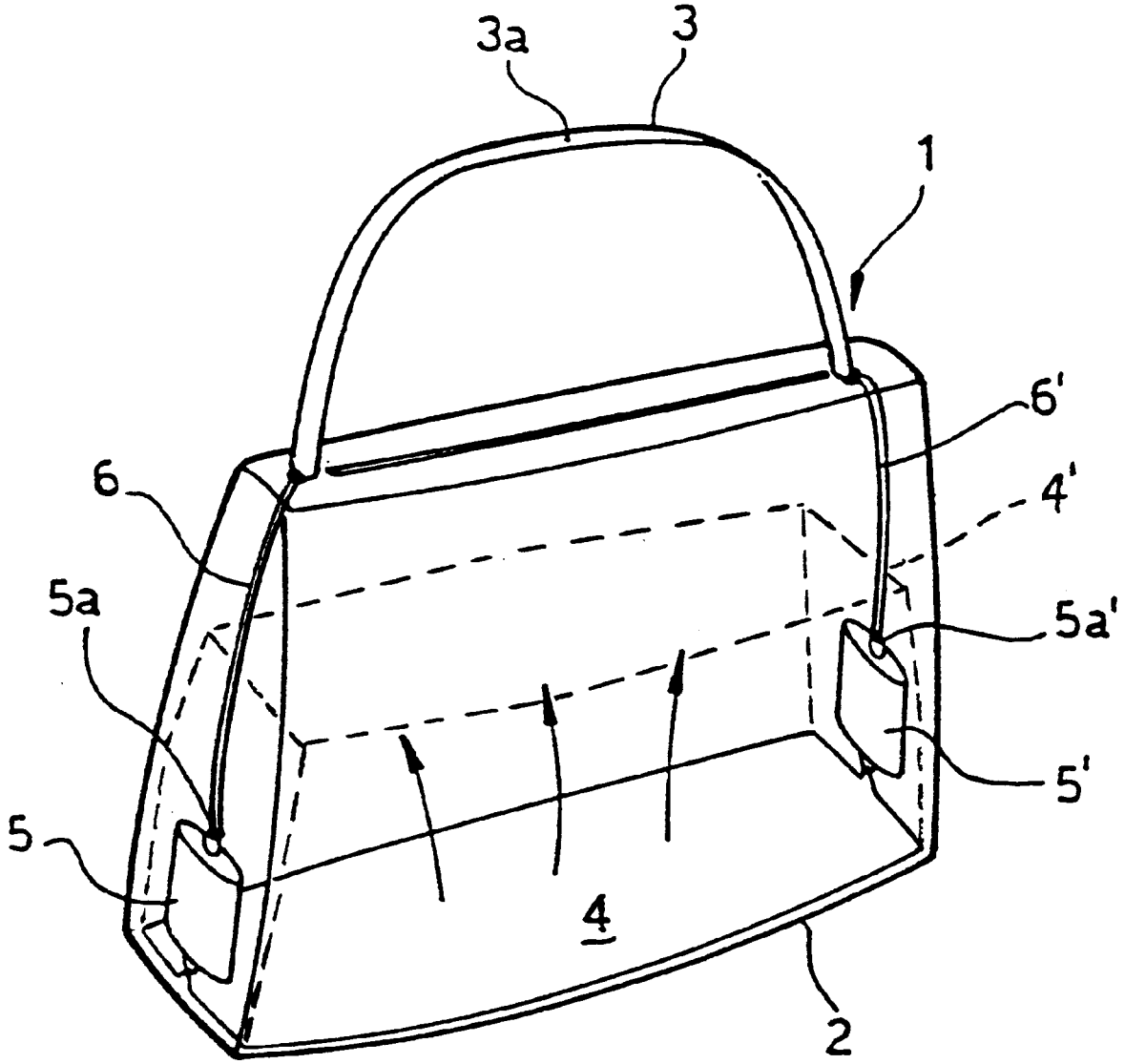

The present invention relates to a bag, particularly, though not exclusively, to a long-strap bag, having a single strap.

It is known that a problem in carrying a bag is represented by possible bag-snatchings, a particularly annoying problem in connection with the fact that it is customary to carry, in addition to cash money and toilet articles, personal documents and keys in bags.

Moreover, long-strap bags are particularly exposed to the danger of bag-snatchings.

The object of the present invention is to provide a bag that has a feature which, though not being able to avoid a bag-snatching, at least prevents the consequences thereof allowing the contents of the bag to be immediately recovered.

Such an object is reached by endowing a bag, in its interior, with a sack means which under a traumatic stress like a snatcher jerk expands in size causing the outgoing of the contents of the bag, which can be immediately picked-up after the bag-snatching.

With this contrivance, in fact, after a bag-snatching the contents are projected out of the bag and fall to the ground. So the thief remains with the empty bay in his hands and the bag-snatched person can pick the contents up.

Therefore, the subject of the present invention is a bag having at least a handle or strap, characterized in that it includes expandable means arranged inside it;

means for actuating the expansion of said expandable means;

means for priming said means for actuating, and means for activating said means for priming when the at least one handle undergoes a jerk by a bag-snatcher.

Another problem of bag-snatchings is that it can cause a person who carries a bag physical harm.

It is a further object of the present invention to provide a bag as set forth above, that solves this second problem too.

Such a problem is solved according to the present invention by endowing at least a handle with a weakness means.

Under the impulse of a bag-snatching this weakness means yields, the hand or strap then breaks in two parts so that the impulse itself is not transferred to the arm, the hand or the shoulder of the person who carries the bag, and causes the priming for the inflation of that sack means at the same time.

Therefore, it is also the subject of the present invention a bag as set forth above, further characterized in that the at least one handle or strap is endowed with a weakness means which makes it yield in correspondence with it under the impulse of a bag-snatching, and in that said means for activating the means for priming are comprised of a continuous contact medium provided in at least one handle and which yields too under the impulse of a bag-snatching.

The present invention will be best understood based on the following detailed disclosure of a preferred embodiment thereof, only given as a matter of example, absolutely not of restriction, with reference to the annexed drawing, the unique FIG. 1 whereof represents a bag according to the present invention with partial transparecnies which put its features into evidence.

A long-strap bag 1 having a bottom 2 and a strap 3 is illustrated in FIG. 1.

An air chamber-like expansible sack 4 is visible in transparency, arranged folded or anyhow compacted or packed, under an inner liner (not represented) of the bag. The sack 4 has a shape complementary with that of the inside of the bag, and has a volume greater than the one confined by the bag itself at its interior, so that on the inflation of the sack itself the complete emptying of the bag is ensured by projection on the outside of its contents.

In FIG. 1 the sack in its folded condition is shown arranged on the bottom 2 of the bag, but other arrangements, for instance laterally in the bag, are possible within the scope of the present invention.

Under the liner, two respective containers 5, 5' are also arranged for gas or compressed air or primer material that causes a gas or air displacement sufficient for filling the sack 4 when the strap handle 3 is traumatically pulled, as takes place in a bag-snatching. In FIG. 1 ties 6, 6' are put into evidence tightened between the two ends of the strap handle 3 and the containers respectively 5, 5' through respective fuses 5*a*, 5*a'* for priming the emission of gas or air by the containers themselves.

When a bag-snatcher pulls the handle of the bag, the ties 6 and 6' activate the fuses 5*a*, 5*a'* respectively. These ones, once activated, prime the emission of the gas or the compressed air from the containers 5, 5' into the expansible sack 4. The phantom lines designated 4' in the drawing shows expansible sack 4 in the partially expanded or inflated condition. The expansion is sudden, like an explosion. Under the expansion force the inner liner is lifted and the contents of the bag are projected outside to fall, thereafter, to the ground. So the thief remains with the bag in his hands and the bag-snatched person can pick the contents up.

According to an improvement of the present invention, the bag has its handle 3 endowed with a weakness means 3*a* in correspondence whereof it yields under the jerk of a bag-snatching. The ties 6, 6' for activating the fuses 5*a*, 5*a'* are end tracts of a continuous contact medium made to run in the handle 3. This continuous contact in the breaking of the handle or strap, causes the priming and then the explosion and consequently the inflation of the sack.

The weakness means on the handle can be comprises of a velcro®, a press-button, a buckle union or any other means that subjected to a load greater than a value yields.

The embodiments set forth are purely indicative. Variants can be designed, of mechanical type too, all falling within the scope of the present invention as defined by the appended claims.

For example, the present invention has been set forth above with reference to a long-strap bag, having one strap, However, the presented teaching can be equally applied to any other type of bag, particularly hand-bags for women, hand-bags for men, bags for carrying valuables.

Moreover, as the means for activating the fuses 5*a*, 5*a* ties have been described that operate mechanically. However, one could also carry out the activation through an electric signal that runs on a conducting wire passing through the handle, which electric signal is started by a yielding of the conductor wire itself in correspondence with a suitable point, as a consequence of a jerk given to the handle by a bag-snatcher, Moreover, two compressed air containers have been illustrated, but a solution having one container only could also be contemplated.

I claim:

1. A self-emptying handbag, comprising:

a bag portion adapted for carrying articles;

a strap portion connected to said bag portion and adapted for carrying said bag portion;

an expandable sack carried within said bag portion and having a volume when expanded greater than the volume of the bag portion;

means for expanding said expandable sack; and activation means operatively communicating with said strap portion for activating the means for expanding said expandable sack when said strap portion is suddenly pulled, whereby upon expansion of said expandable sack to a volume greater than the volume of s aid bag portion the articles therein are expelled therefrom.

2. The self-emptying handbag as defined in claim 1, wherein said means for expanding said expandable sack comprises at least one compressed gas container operatively connected to said expandable sack.

3. The self-emptying handbag as defined in claim 2, wherein said activation means comprises a tie operatively connecting said strap portion to said at least one compressed gas container.

4. The self-emptying handbag as defined in claim 1, wherein said strap portion includes a weakness means (3*a*) which permits the strap portion to yield when said strap portion is suddenly pulled.

* * * * *